US007841203B2

(12) United States Patent
Yoon et al.

(10) Patent No.: US 7,841,203 B2
(45) Date of Patent: Nov. 30, 2010

(54) ICE TRAY ASSEMBLY AND REFRIGERATOR HAVING THE SAME

(75) Inventors: Jong Seok Yoon, Changwon-Si (KR); Byeong Gyu Kang, Changwon-Si (KR); Jae Youl Lee, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 690 days.

(21) Appl. No.: 11/806,022

(22) Filed: May 29, 2007

(65) Prior Publication Data

US 2007/0283714 A1 Dec. 13, 2007

(30) Foreign Application Priority Data

May 29, 2006 (KR) ..... 10-2006-0048357

(51) Int. Cl.
*F25C 1/12* (2006.01)

(52) U.S. Cl. ..... 62/344; 249/118; 249/137; 249/161

(58) Field of Classification Search ..... 62/340, 62/344; 249/118, 120, 137, 160–162
See application file for complete search history.

(56) References Cited

U.S. PATENT DOCUMENTS

| | | | | | |
|---|---|---|---|---|---|
| 917,036 | A * | 4/1909 | Folden | 249/118 |
| 2,212,405 | A * | 8/1940 | Rose et al. | 62/345 |
| 2,381,068 | A * | 8/1945 | Lutes et al. | 249/70 |
| 3,188,827 | A * | 6/1965 | Bauerlein | 62/137 |
| 4,306,423 | A * | 12/1981 | Webb et al. | 62/353 |
| 5,830,379 | A * | 11/1998 | Tunzi | 249/126 |
| 6,481,235 | B2 * | 11/2002 | Kwon | 62/353 |
| 7,204,092 | B2 * | 4/2007 | Azcarate Castrellon et al. | 62/72 |
| 2005/0241329 | A1 | 11/2005 | Castrellon et al. | |

* cited by examiner

*Primary Examiner*—William E Tapolcai
(74) *Attorney, Agent, or Firm*—Birch, Stewart, Kolasch & Birch, LLP

(57) ABSTRACT

An ice tray assembly and refrigerator having the same are disclosed, by which pieces of ice stored in a plurality of ice trays can be simultaneously discharged by a single motion without interfering with each other. The present invention includes a plurality of ice trays vertically provided within a case, a plurality of the ice trays connected to one another by an interoperating means to be simultaneously rotated and a driving means for rotating a plurality of the ice trays by being connected thereto.

9 Claims, 4 Drawing Sheets

ICE TRAY ASSEMBLY AND REFRIGERATOR HAVING THE SAME

This application claims the benefit of the Korean Patent Application No. 10-2006-0048357, filed on May 29, 2006, which is hereby incorporated by reference as if fully set forth herein.

BACKGROUND OF THE INVENTION

1. Field of the Invention

The present invention relates to an ice tray assembly and refrigerator having the same. Although the present invention is suitable for a wide scope of applications, it is particularly suitable for discharging the ice stored in a plurality of ice trays by a single motion without interference.

2. Discussion of the Related Art

FIG. 4 is a perspective diagram of an ice tray assembly according to a related art.

Referring to FIG. 4, an ice tray assembly according to a related art consists of a case 10 provided within a refrigerator and a plurality of ice trays 20 loaded in the case 10 to make ice therein.

And, slots 12 are provided to the case 10. So, the ice tray 20 can be fitted into the slots 12.

In the above-configuration, ice is made in a manner of putting water in the ice tray 20, loading the ice tray 20 in the case 10, and then applying cold air flowing within the refrigerator to the water.

However, in the related art ice tray assembly, it is inconvenient that the ice tray 20 should be unloaded from the case 10 to separate the ice from the ice tray 20.

When the ice tray 20 is loaded in the case 10, if the water in the ice tray 20 overflows from the ice tray 20 to the case 20, ice is made between the case 10 and the ice tray 20. So, it is difficult to separate the ice tray 20 from the case 10.

Besides, the related art ice tray assembly is not provided with a separate space for storing the ice, which was separated from the ice tray 20, within the refrigerator. So, it is inefficient to make and store ice.

SUMMARY OF THE INVENTION

Accordingly, the present invention is directed to an ice tray assembly and refrigerator having the same that substantially obviate one or more problems due to limitations and disadvantages of the related art.

An object of the present invention is to provide an ice tray assembly and refrigerator having the same, by which ice can be separated from a plurality of ice trays without taking the ice trays out of a case.

Another object of the present invention is to provide an ice tray assembly and refrigerator having the same, by which ice can be made in a manner of supplying water to a plurality of ice trays without taking the ice trays out of a case.

Another object of the present invention is to provide an ice tray assembly and refrigerator having the same, by which pieces of ice separated from a plurality of ice trays can be uniformly staked without interference in-between.

A further object of the present invention is to provide an ice tray assembly and refrigerator having the same, by which ice can be separated from a plurality of ice trays by a single motion.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice tray assembly according to the present invention includes a plurality of ice trays vertically provided within a case, a plurality of the ice trays connected to one another by an interoperating means to be simultaneously rotated and a driving means for rotating a plurality of the ice trays by being connected thereto.

Preferably, the interoperating means includes a plurality of tray gears connected to a plurality of the ice trays, respectively and a plurality of connecting gears enabling a plurality of the tray gears to interoperate with each other.

More preferably, the driving means includes a lever connected to one selected from the group consisting of the ice tray, the tray gear, and the connecting gear.

In this case, the ice tray assembly further includes an elastic member providing a recovering force when the lever is rotated.

Preferably, a plurality of the ice trays are arranged to configure an oblique line.

Preferably, the ice tray is provided with a hanging projection for releasing a fixed state of the cover when ice is taken out of the ice tray.

Preferably, a water supply passage for supplying water to the ice tray is provided to the case.

In another aspect of the present invention, a refrigerator includes a door and an ice tray assembly including a plurality of ice trays provided in a vertically oblique line form to a case provided to a backside of the door and a driving means for rotating a plurality of the ice trays by being connected thereto.

Preferably, the ice tray assembly further includes an interoperating means for rotating a plurality of the ice trays simultaneously by being connected thereto includes a plurality of tray gears connected to a plurality of the ice trays, respectively and a plurality of connecting gears enabling a plurality of the tray gears to interoperate with each other.

Preferably, the case includes an ice-making part accommodating a plurality off the ice trays therein and an operating part provided with the operating means.

More preferably, the case further includes a water supply part having a water supply passage for supplying water to a plurality of the ice trays.

In this case, the ice-making part, the operating part, and the water supply part are partitioned from each other by at least one partition.

Preferably, the case includes a basket provided under a plurality of the ice trays to store pieces of ice falling from a plurality of the ice trays.

Preferably, the driving means includes a lever connected to one selected from the group consisting of the ice tray, the tray gear, and the connecting gear.

More preferably, the refrigerator further includes an elastic member providing a recovering force when the lever is rotated.

Preferably, the ice tray is provided with a hanging projection for releasing a fixed state of the cover when ice is taken out of the ice tray.

Therefore, the present invention provides the following useful effects.

First of all, ice can be separated from a plurality of ice trays without taking the ice trays out of a case.

Secondly, ice can be made in a manner of supplying water to a plurality of ice trays without taking the ice trays out of a case.

Thirdly, pieces of ice separated from a plurality of ice trays can be uniformly staked without interference in-between.

Fourthly, ice can be separated from a plurality of ice trays by a single motion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
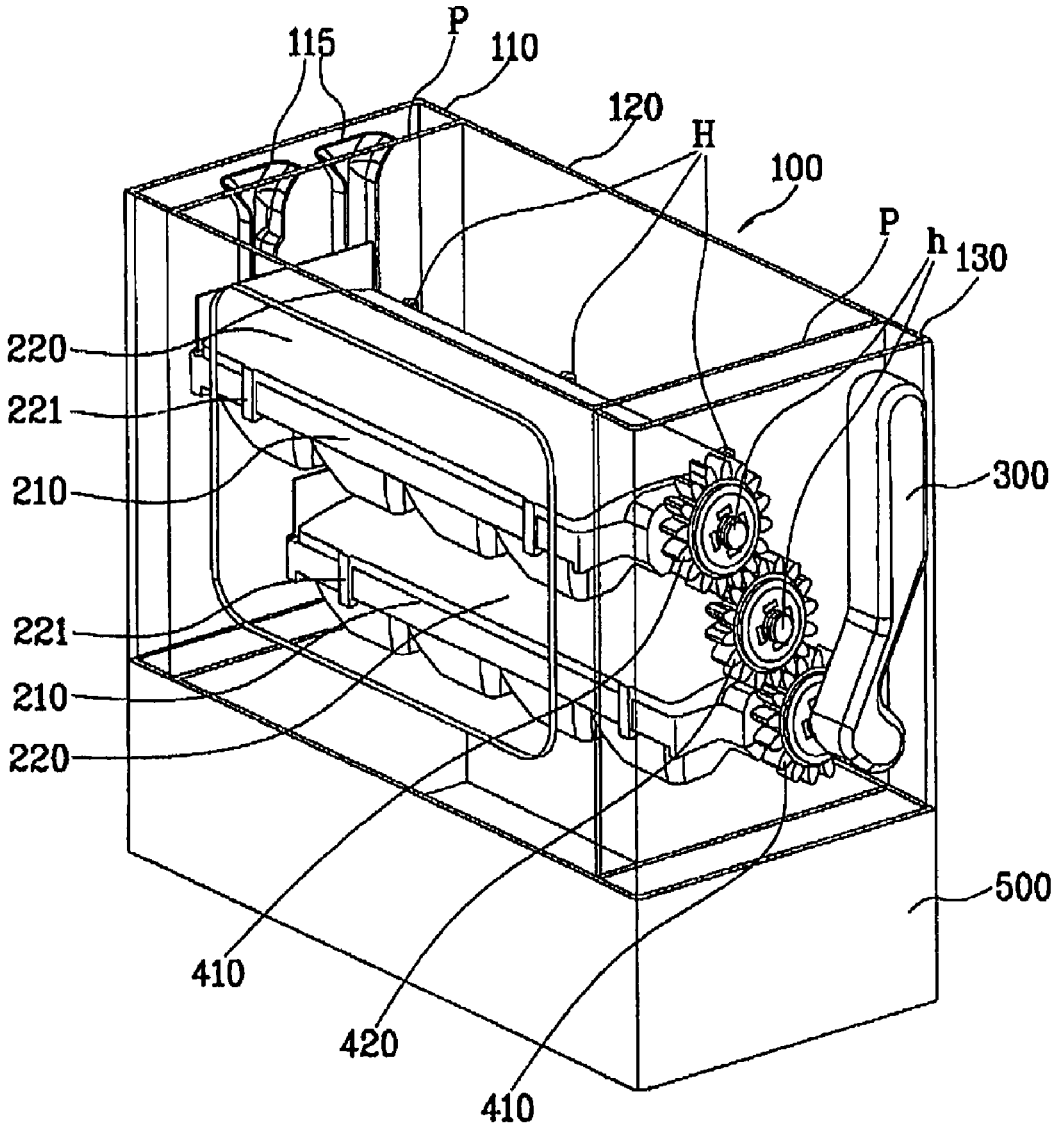
FIG. 1 is a perspective diagram of an ice tray assembly of a refrigerator according to the present invention.

FIG. 1 is a perspective diagram of an ice tray assembly of a refrigerator according to the present invention.

Referring to FIG. 1, an ice tray assembly of a refrigerator according to the present invention includes a plurality of rotatable ice trays 210 and a driving means.

And, a refrigerator having the ice tray assembly includes a case 100, a lever 300 playing a role as the driving means, tray and connecting gears 410 and 420 playing a role as an interoperating means for rotating a plurality of the ice trays 210 simultaneously, and a basket 500.

Preferably, the case 100 is configured to have a hexahedral shape vertically extending long to align the ice trays 210 in a vertical direction. So, it is able to minimize a space for loading the ice tray assembly having the ice trays 210 and the driving means therein.

Preferably, a bottom side of the case 100 is open to enable ice separated from the ice tray 210 to pass through. Preferably, at least one of lateral sides of the case 100 is formed of a transparent material to facilitate a frozen status of the ice made in the ice tray 210 to be visually observed from outside of the case 100.

In particular, the case 100 is provided with a water supply part 110, an ice-making part 120, and an operating part 130. And, the water supply part 110, the ice-making part 120, and the operating part 130 are sequentially aligned from one side of the case 100.

And, the case 100 is further provided with a partition (P) partitioning the water supply part 110 and the ice-making part 120 from each other and another partition (P) partitioning the ice-making part 120 and the operating part 130 from each other, to prevent water supply, ice-making and operation from interfering with each other.

Moreover, the case 100 is provided with a water supply passage for supplying water to the ice tray 210. In the present embodiment, the water supply passage 115 includes a vertically long duct provided to the partition P, which partitions the water supply part 110 and the ice-making part 120 from each other, to be connected to the ice tray 210.

Besides, the case 100 is provided with holes (h) into which the tray and connecting gears 410 and 320 are fitted, respectively. In the present embodiment, the holes (h) are provided to the partition (P) partitioning the ice-making part 120 and the operating part 130 from each other.

Meanwhile, water is put in a plurality of the ice trays 210 and then frozen into ice. So, a cover 220 is preferably provided to cover the ice trays 210 to for more hygienic storage of the ice.

To prevent the water supplied to the ice tray 210 from overflowing out of the ice tray 210 that is moving, a hanging projection 221, of which lock is released in case of taking out the ice, is preferably provided to the cover 220.

In this case, the cover 220 is assembled to the ice tray 210 by a hinge (H) to open/close an upper side of the ice tray 210. In order to open the cover 220 in rotating the ice tray 210, if the ice tray 210 is rotated clockwise, the cover 220 is preferably hinged to a left part of the ice tray 210 centering on a middle part of the ice tray 210. If the ice tray 210 is rotated counterclockwise, the cover 220 is preferably hinged to a right part of the ice tray 210 centering on a middle part of the ice tray 210.

Figure 2:
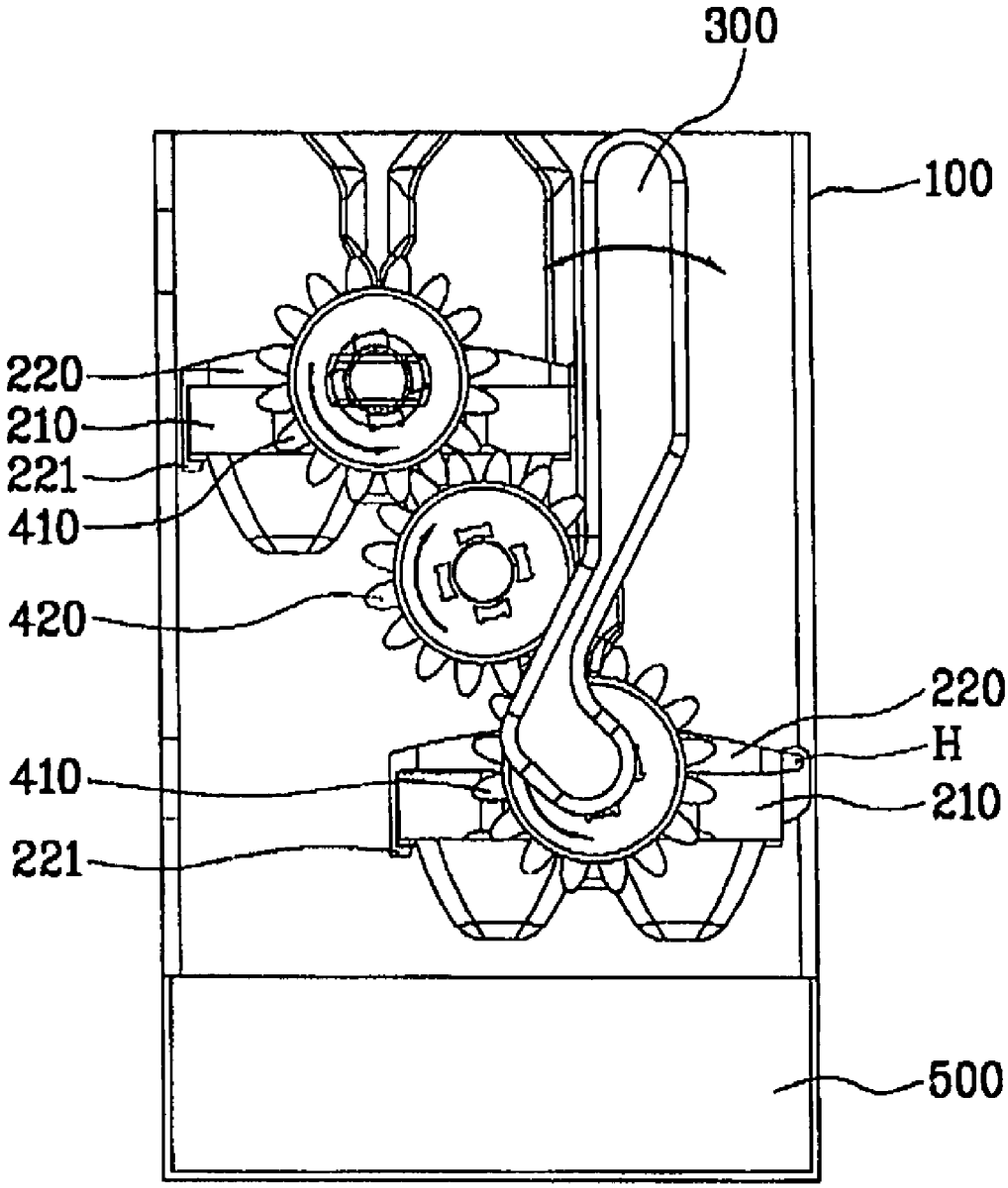
FIG. 2 is a right front diagram of the ice tray assembly shown in FIG. 1.
Figure 3:
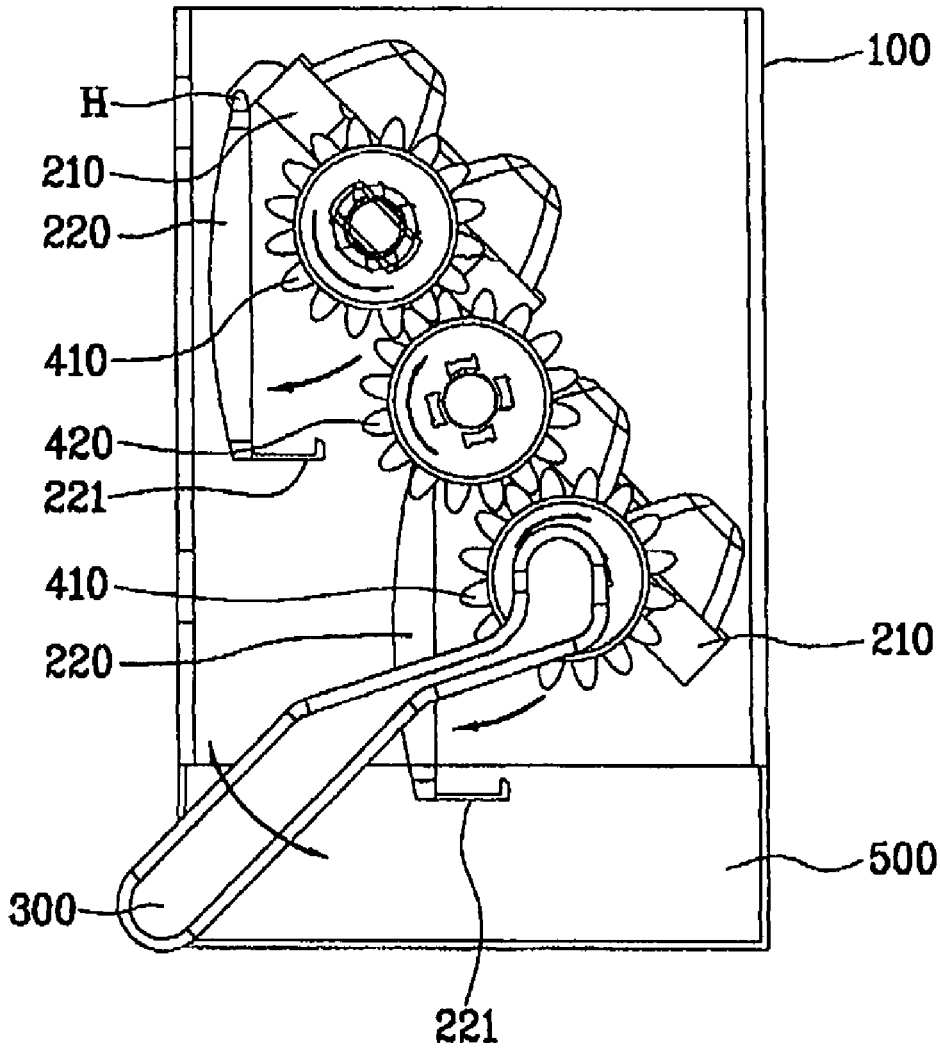
FIG. 3 is a diagram to explain how to operate the ice tray assembly shown in FIG. 1.
Figure 4:
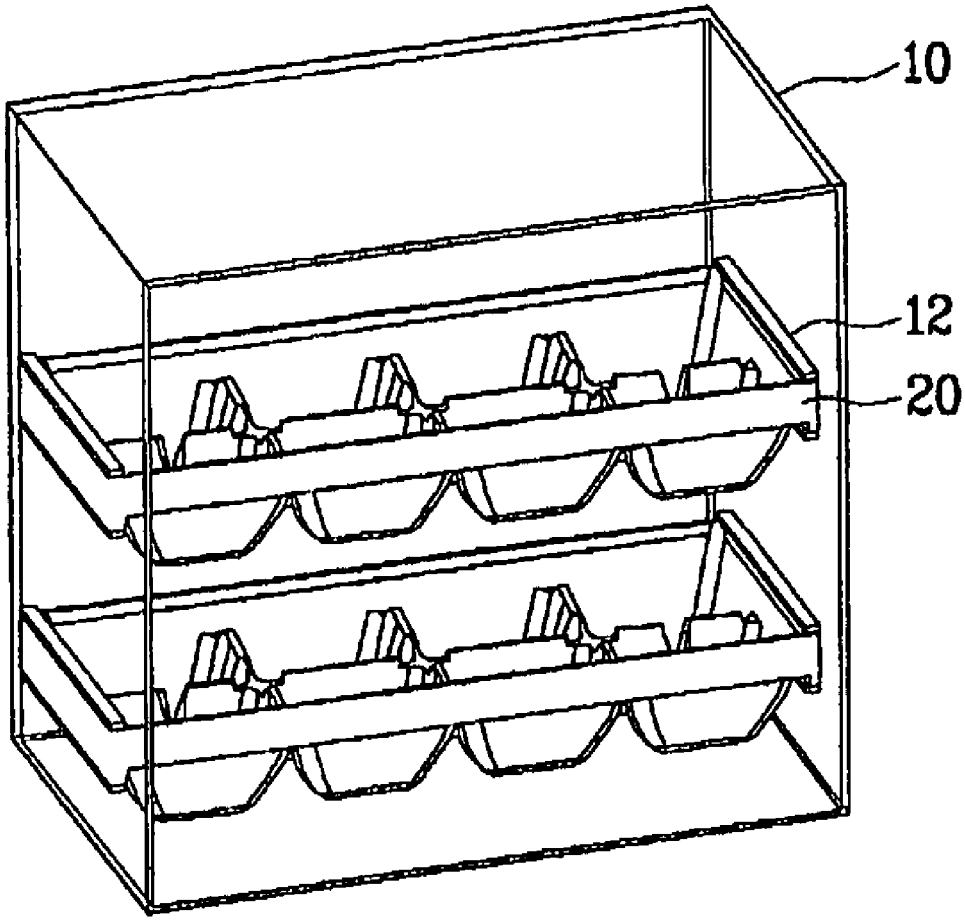
FIG. 4 Related Art
FIG. 4 is a perspective diagram of an ice tray assembly according to a related art.

In the present embodiment, since the ice tray 210 is rotated counterclockwise, the cover 220, as shown in FIG. 2 or FIG. 3, is assembled to the right part of the ice tray 210 centering on the middle part of the ice tray 210 via the hinge (H).

In order to release the cover 220 from the ice tray 210 in rotating the ice tray 210, it is preferable that a bar (not shown in the drawing) for separating the hanging projection 221 from the ice tray 210 is provided to the case 100. If so, the cover 220 is automatically opened when the ice tray 210 is rotated. Hence, ice separated from the ice tray 210 can fall.

In the present embodiment, a plurality of the ice trays 210 are arranged in a vertical direction. And, each of a plurality o the ice trays 210 is installed to rotate within the case 100. Alternatively, a plurality of the ice trays 210 can be configured not to rotate simultaneously.

For this, a vertical shaft of the ice tray 210 is preferably connected to the tray gear 410 fitted into the hole (h) provided to the partition (P) partitioning the water supply part 110 and the ice-making part 120 and the hole (h) provided to the partition (P) partitioning the ice-making part 120 and the operating part 130.

In this case, a plurality of the ice trays 210 are preferably arranged to incline in a vertically oblique line shape in order for a plurality of the ice trays 210 not to interfere with pieces of the ice separated from each of the ice trays 210 when the ice is separated from each of the rotating ice trays 210.

In the present embodiment, it is preferable that a plurality of the ice trays, as shown in FIGS. 1 to 3, are arranged to configure the oblique line extending from a left upper side to a right lower side in a standpoint of a right side of the case 100.

The lever 300 is the driving means for rotating the ice tray 210 connected to the lever 300. In the present embodiment, the lever 200 is one of a plurality of the ice trays 210. And, the lever 200 moves rotationally together with one of a plurality of the ice trays 210.

According to another embodiment of the present invention, the lever 200 can be assembled to the tray gear 410 instead of being connected to the corresponding ice tray 210. And, the lever 300 can be replaced by one of various means for rotating the ice tray 210. For example, the lever 300 can be replaced by a driving motor controlled by a controller or the like.

Preferably, the lever 300 is provided with an elastic member (not shown in the drawing) to provide a recovering force in case of its rotation. So, the lever 300 is preferably configured to recover to its original position without an external force after having been driven.

In the present embodiment, in order to secure a space for the rotation of the lever 300, the lever 30 is connected to the ice tray 210, to which is the lever 300 is assembled, provided to the right lower side of the case 100 to interoperate with the tray gear 410. And, the lever 300 is turned counterclockwise.

According to another embodiment of the present invention, the lever 300, which is assembled to the interoperating gear 420 to interoperate the tray gear 410 provided to the ice tray 210, can rotate the ice tray 210 overall.

The tray gear 410 is connected to each of a plurality of the ice rays 210. So, a plurality of the trays gears engage with one another. For the same rotation of the ice tray 210, a plurality of the tray gears 410 are preferably connected to shafts of a plurality of the ice trays 210, respectively.

In this case, to maintain the same rotational angle, the same gear ratio is provided to each of a plurality of the tray gears 410 respectively connected to a plurality of the ice trays 210.

In the present embodiment, the connecting gear 420 connects a plurality of the tray gears 410 to enable a plurality of the ice trays 210 to rotate in the same direction of the rotational direction of the lever 300. Preferably, in order to enable a plurality of the ice trays 210 to rotate in the same rotational direction of the lever 300, a plurality of the connecting gears 420 are provided between the tray gears 410 connected to a plurality of the ice trays 210, respectively.

Preferably, the connecting gear 420 has the same gear ratio of the tray gear 410 to enable the tray gear 410, which is connected to each of a plurality of the ice trays 210, to maintain the same rotational angle.

The basket 500 is provided under a plurality of the ice trays 210. In the present embodiment, the basket 500 is preferably provided in a lower area including a plurality of the ice trays 210 to store the ice falling from a plurality of the rotated ice trays 210.

Operations of the above-configured ice tray assembly and the refrigerator having the same according to the present invention are explained as follows.

First of all, if the lever 300, as shown in FIG. 3, is turned from the case 100 counterclockwise, the ice tray 210 connected to the lever 300 and the tray gear 410 are rotated in the same direction of the turned lever 300.

As the tray gear 410 is rotated counterclockwise, the connecting gear 420 connected to the tray gear 410 is rotated in a direction opposite to the rotational direction of the tray gear 410, i.e., clockwise.

The tray gear 410 connected to the ice tray 210, which is not connected to the lever 300 among a plurality of the ice trays 210, is rotated in a direction opposite to the rotational direction of the connecting gear, i.e., counterclockwise in correspondence to the rotation of the connection gear 420, whereby the ice tray 210 failing to be connected to the lever 300 among a plurality of the ice trays 210 is rotated in the same direction of the ice tray 210 connected to the lever 300.

Hence, each of a plurality of the ice trays 210 is rotated in the same direction to open the cover 220 and the pieces of the ice are separated from the ice trays 210. In this case, since a plurality of the ice trays 210 are arranged to configure a vertically oblique line type incline, the pieces of the ice separated from the ice trays 210 avoid interfering with each other to be evenly accumulated in the basket 50.

According to another embodiment of the present invention, it is a mater of course that a plurality of the ice trays 210, which are arranged to configure the vertically oblique line and enable the falling pieces of the ice to be evenly accumulated without interfering with each other, can be respectively rotated instead of being simultaneously rotated.

Accordingly, the present invention provides the following effects or advantages.

First of all, ice can be separated from a plurality of ice trays without taking the ice trays out of a case.

Secondly, ice can be made in a manner of supplying water to a plurality of ice trays without taking the ice trays out of a case.

Thirdly, pieces of ice separated from a plurality of ice trays can be uniformly staked without interference in-between.

Fourthly, ice can be separated from a plurality of ice trays by a single motion.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An ice tray assembly comprising:

a plurality of ice trays vertically provided within a case, a plurality of the ice trays connected to one another by an interoperating means to be simultaneously rotated; and a driving means for rotating a plurality of the ice trays by being connected thereto, wherein the interoperating means comprises a plurality of tray gears connected to a plurality of the ice trays, respectively, and a plurality of connecting gears enabling a plurality of the tray gears to interoperate with each other, wherein a plurality of the ice trays are arranged to configure an oblique line, wherein the driving means comprises a lever connected to one selected from the group consisting of the ice tray, the tray gear, and the connecting gear, and further comprising an elastic member providing a recovering force when the lever is rotated.

2. The ice tray assembly of claim 1, further comprising a cover assembled to the ice tray by a hinge to open/close an upper side of the ice tray, wherein the ice tray is provided with a hanging projection for releasing a fixed state of the cover when ice is taken out of the ice tray.

3. The ice tray assembly of claim 1, wherein a water supply passage for supplying water to the ice tray is provided to the case.

4. A refrigerator comprising:

a door; and an ice tray assembly comprising:

a plurality of ice trays provided in a vertically oblique line form to a case provided to a backside of the door;

a driving means for rotating a plurality of the ice trays by being connected thereto;

an interoperating means for rotating a plurality of the ice trays simultaneously by being connected thereto, the interoperating means comprising:

a plurality of tray gears connected to a plurality of the ice trays, respectively; and a plurality of connecting gears enabling a plurality of the tray gears to interoperate with each other; and a cover assembled to the ice tray by a hinge to open/close an upper side of the ice tray, wherein the driving means comprises a lever connected to one selected from the group consisting of the ice tray, the tray gear, and the connecting gear, and further comprising an elastic member providing a recovering force when the lever is rotated.

5. The refrigerator of claim 4, the case comprising:

an ice-making part accommodating a plurality off the ice trays therein; and an operating part provided with the operating means.

6. The refrigerator of claim 5, the case further comprising a water supply part having a water supply passage for supplying water to a plurality of the ice trays.

7. The refrigerator of claim 6, wherein the ice-making part, the operating part, and the water supply part are partitioned from each other by at least one partition.

8. The refrigerator of claim 4, the case comprising a basket provided under a plurality of the ice trays to store pieces of ice falling from a plurality of the ice trays.

9. The refrigerator of claim 4, wherein the ice tray is provided with a hanging projection for releasing a fixed state of the cover when ice is taken out of the ice tray.

* * * * *